US010224592B2

(12) United States Patent
Tinaphong et al.

(10) Patent No.: US 10,224,592 B2
(45) Date of Patent: Mar. 5, 2019

(54) STAND FOR PLANAR ANTENNA

(71) Applicant: VOXX International Corporation, Hauppauge, NY (US)

(72) Inventors: Prapan Paul Tinaphong, Carmel, IN (US); Yiqi W. Woodling, Carmel, IN (US); Dzam-Si Jesse Ng, Zionsville, IN (US)

(73) Assignee: VOXX International Corporation, Hauppauge, NY (US)

( * ) Notice: Subject to any disclaimer, the term of this patent is extended or adjusted under 35 U.S.C. 154(b) by 183 days.

(21) Appl. No.: 15/219,503

(22) Filed: Jul. 26, 2016

(65) Prior Publication Data

US 2017/0033463 A1 Feb. 2, 2017

Related U.S. Application Data

(60) Provisional application No. 62/198,284, filed on Jul. 29, 2015, provisional application No. 62/271,794, filed on Dec. 28, 2015.

(51) Int. Cl.
*H01Q 1/42* (2006.01)
*H01Q 1/12* (2006.01)
(Continued)

(52) U.S. Cl.
CPC ..... *H01Q 1/1207* (2013.01); *H01Q 1/26* (2013.01); *H01Q 1/42* (2013.01); *H01Q 9/285* (2013.01); *H01Q 19/30* (2013.01); *H01Q 9/26* (2013.01)

(58) Field of Classification Search
CPC ..... H01Q 9/285; H01Q 1/26; H01Q 1/42; H01Q 19/30; H01Q 9/26; H01Q 5/0027
(Continued)

(56) References Cited

U.S. PATENT DOCUMENTS

D266,461 S 10/1982 Helzer ..... D6/310
D276,961 S 1/1985 Kemper ..... D7/601
(Continued)

FOREIGN PATENT DOCUMENTS

DE 78 05 520 6/1978 ..... H01Q 1/12

OTHER PUBLICATIONS

The Notification of Transmittal of the International Search Report and the Written Opinion of the International Searching Authority, or the Declaration, dated Oct. 18, 2016, which was issued by the International Bureau of WIPO in Applicant's corresponding international PCT application having Serial No. PCT/US2016/044017, filed on Jul. 26, 2016.

(Continued)

*Primary Examiner* — Hai Tran
(74) *Attorney, Agent, or Firm* — Bodner & O'Rourke, LLP; Gerald T. Bodner; Christian P. Bodner

(57) ABSTRACT

An antenna stand for holding a flexible or non-flexible planar antenna includes a base and support frame. The support frame includes two spaced apart legs and a horizontal cross member interposed therebetween. At least two lower antenna supports are provided on the support frame on which the bottom edge of the planar antenna may rest. An optional extendable antenna holding arm includes an upper antenna clip that engages the top edge of the planar antenna. The extendable antenna holding arm support is adjustably mounted to the support frame so that the distance between the lower antenna supports and the upper antenna clip can be varied to accommodate planar antennas of varying dimensions. The support frame may be arcuately shaped transversely to impart a slight lateral bend to a flexible planar antenna mounted on the stand. This helps to maintain the flexible planar antenna in an upright position on the stand.

20 Claims, 19 Drawing Sheets

(51) Int. Cl.

| | |
|---|---|
| ***H01Q 9/28*** | (2006.01) |
| ***H01Q 1/26*** | (2006.01) |
| ***H01Q 19/30*** | (2006.01) |
| *H01Q 9/26* | (2006.01) |

(58) Field of Classification Search
USPC ..... 343/702, 700 MS, 872, 834
See application file for complete search history.

(56) References Cited

U.S. PATENT DOCUMENTS

| | | | | |
|---|---|---|---|---|
| D307,686 | S | 5/1990 | Cadman | D6/572 |
| 6,429,828 | B1 | 8/2002 | Tinaphong et al. | 343/824 |
| 6,590,541 | B1 | 7/2003 | Schultze | 343/741 |
| 7,495,618 | B2 * | 2/2009 | Kurashima | H01Q 1/22 343/700 MS |
| D635,013 | S | 3/2011 | Larsen | D8/380 |
| D659,686 | S | 5/2012 | Podduturi | D14/230 |
| 8,269,672 | B2 | 9/2012 | Tinaphong et al. | 343/700 MS |
| D723,358 | S | 3/2015 | Morris | D8/380 |
| D724,418 | S | 3/2015 | Fairchild | D8/380 |
| D743,952 | S | 11/2015 | Venghaus et al. | D14/238 |
| 9,281,571 | B2 | 3/2016 | Tinaphong et al. | 343/700 MS |
| 9,711,868 | B2 * | 7/2017 | Scheucher | H01Q 19/30 |
| 2003/0184497 | A1 | 10/2003 | Ye et al. | 343/909 |
| 2007/0096995 | A1 | 5/2007 | Lee | 343/702 |
| 2013/0313401 | A1 | 11/2013 | Yang | 248/651 |
| 2014/0043205 | A1 * | 2/2014 | Lam | H01Q 1/08 343/872 |
| 2015/0331210 | A1 * | 11/2015 | Lee | G02B 6/4277 385/89 |

OTHER PUBLICATIONS

The Written Opinion of the International Searching Authority, dated Oct. 18, 2016, which was issued by the International Bureau of WIPO in Applicant's corresponding international PCT application having Serial No. PCT/US2016/044017, filed on Jul. 26, 2016.

The International Search Report, dated Oct. 18, 2016, which was issued by the International Bureau of WIPO in Applicant's corresponding international PCT application having Serial No. PCT/US2016/044017, filed on Jul. 26, 2016.

* cited by examiner

STAND FOR PLANAR ANTENNA

CROSS-REFERENCE TO RELATED APPLICATIONS

This application is related to U.S. Provisional Patent Application Ser. No. 62/198,284, filed on Jul. 29, 2015, and entitled "Stand for Planar Antenna" and U.S. Provisional Patent Application Ser. No. 62/271,794, filed on Dec. 28, 2015, and entitled "Stand for Planar Antenna", the disclosure of each of which is hereby incorporated by reference and on which priority is hereby claimed.

BACKGROUND OF THE INVENTION

Field of the Invention

The present invention generally relates to television antennas, and more specifically relates to supports for holding such television antennas in an upright position.

Description of the Prior Art

There are a number of planar indoor television antennas which receive digitally formatted high definition broadcast signals. Two such antennas, having a hard body, plastic planar housing, are disclosed in U.S. Pat. No. 6,429,828, which issued to Prapan Paul Tinaphong, et al., and is entitled "VHF/UHF Self-Tuning Planar Antenna System", and U.S. Pat. No. 8,269,672, which also issued to Prapan Paul Tinaphong, et al., and is entitled "Omni-Directional, Multi-Polarity Low-Profile Planar Antenna", the disclosures of which are incorporated herein by reference. There are also planar television antennas currently on the market which are formed with an ultra-thin, flexible housing. An example of such a flexible planar antenna is disclosed in U.S. Patent Application Publication No. 2015/0054705, which issued as U.S. Pat. No. 9,281,571, naming as inventors Prapan Paul Tinaphong, et al., and entitled "Ultra-Thin, Flexible, Broadband Low Profile Planar Wire Antenna", the disclosure of which is incorporated herein by reference.

Although the aforementioned planar high definition television antennas will work to receive signals when disposed in a horizontal position, it is usually recommended that such antennas be disposed in an upright, vertical position, preferably near a window or at a high elevation, for best reception of television broadcast signals. Some of these planar television antennas have openings or recesses on their housings for mounting the antennas on a wall or to a window in a vertical position.

However, it may be desired by the owner of such a planar antenna not to mount the antenna permanently to a wall or window, and yet be able to secure the antenna in an upright, vertical position without it tipping over.

OBJECTS AND SUMMARY OF THE INVENTION

It is an object of the present invention to provide an antenna stand for mounting a planar television antenna in an upright, vertical position.

It is another object of the present invention to provide an antenna stand for holding flexible planar antennas in an upright position and provide support for such flexible antennas so that they do not bend while being held in such an upright position.

It is still another object of the present invention to provide an antenna stand for planar television antennas, which stand is adjustable so that it may receive and hold in an upright, vertical position planar antennas of differing dimensions.

It is a further object of the present invention to provide an antenna stand for flexible and hard case planar television antennas which avoids the need for having to mount such antennas permanently or semi-permanently on a window or wall.

In accordance with one form of the present invention, a stand for receiving and holding a planar television antenna includes a base, a support frame mounted on the base, and an extendable antenna holding arm which is adjustably mounted on the frame. The frame preferably includes a pair of lower clips that project outwardly from a surface thereof on which the bottom edge of a planar antenna may rest. The extendable arm includes an upper clip projecting from a surface thereof which may be used to engage the opposite upper edge of the planar antenna.

Accordingly, a planar television antenna, such as those described previously, may be mounted on the antenna stand of the present invention and disposed between the lower clips of the frame and the upper clip of the extendable arm. The extendable arm may be adjusted on the frame so that the position of the upper clip relative to the lower clips may be adjusted such that the antenna stand may accommodate and support planar antennas having housings of different dimensions.

In accordance with another form of the present invention, a stand for receiving and holding a planar television antenna includes a base and a laterally arcuate support frame mounted on the base. The frame preferably includes a pair of clips that project outwardly from a surface thereof on which the bottom edge of a planar antenna may rest.

Accordingly, a planar television antenna, especially one which has a non-rigid, flexible housing such as disclosed in the aforementioned U.S. Patent Application Publication No. 2015/0054705 (now, U.S. Pat. No. 9,281,571), may be mounted on the antenna stand of the present invention and disposed on the clips of the frame. The curvature of the arcuate shape of the antenna support frame imparts a slight curvature or bend transversely (i.e., horizontally) to the flexible planar antenna mounted on the stand, and this slight curvature or bend will maintain the antenna in an upright position and prevent the antenna from folding over on itself. The antenna stand adds rigidity to a flexible planar antenna in the vertical direction, and the flexible planar antenna will remain in an upright position even though it only rests at its lower edge on the clips of the stand and without the need for the antenna stand to support its upper edge.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
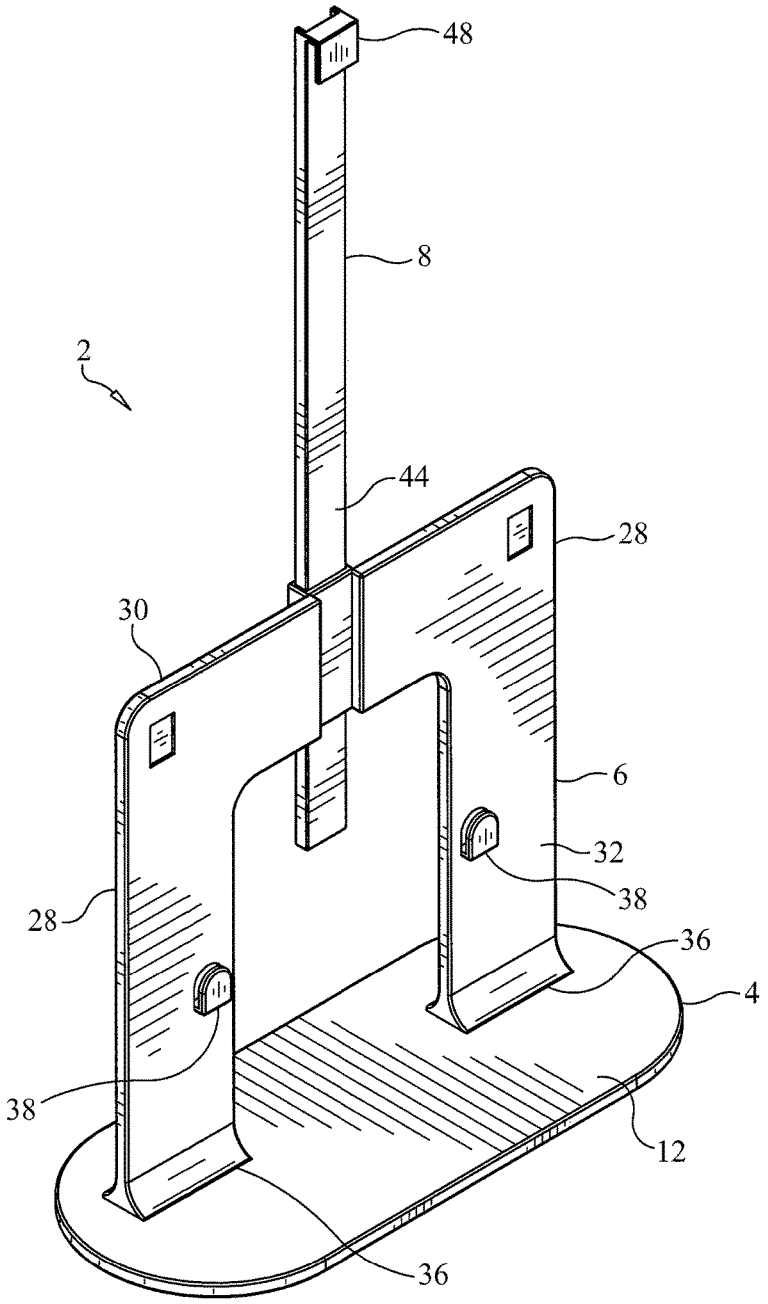
FIG. 1 is a front top perspective view of an antenna stand for holding a planar television antenna constructed in accordance with one form of the present invention.
Figure 2:
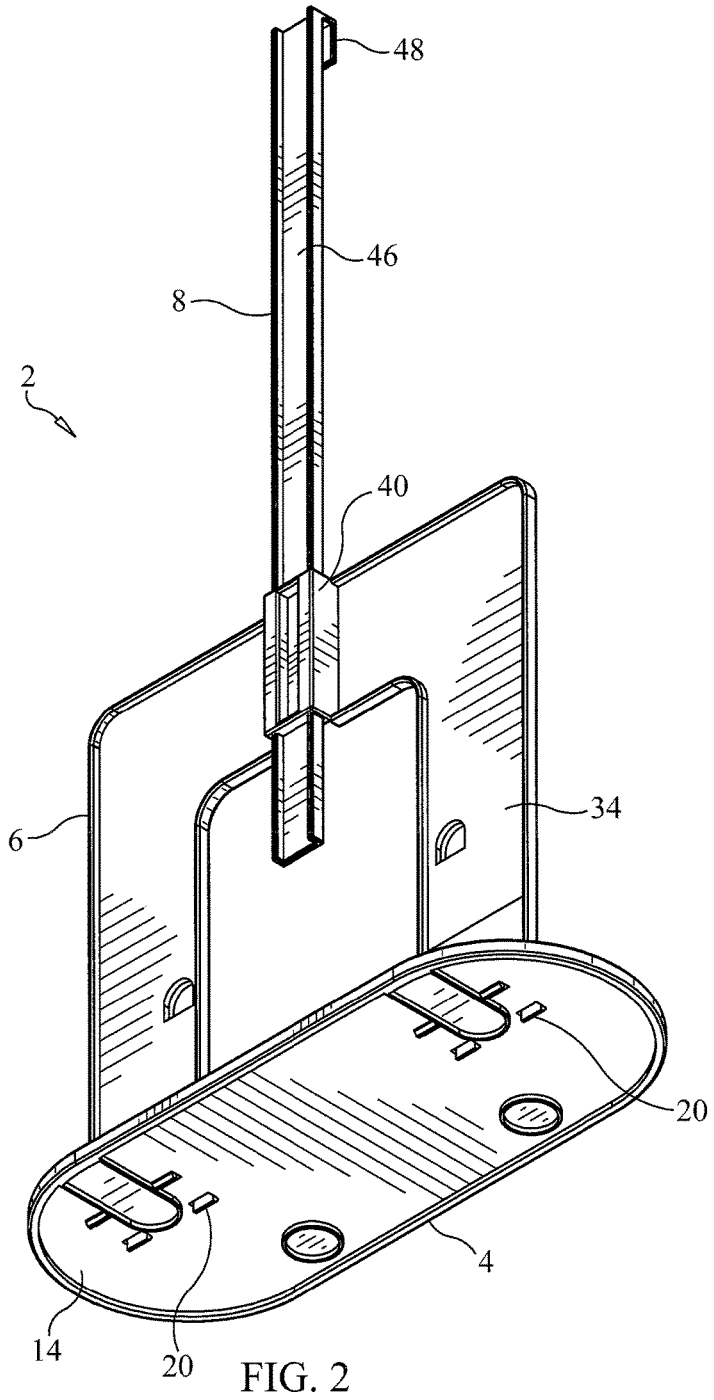
FIG. 2 is a rear bottom perspective view of the antenna stand of the present invention shown in FIG. 1.
Figure 3:
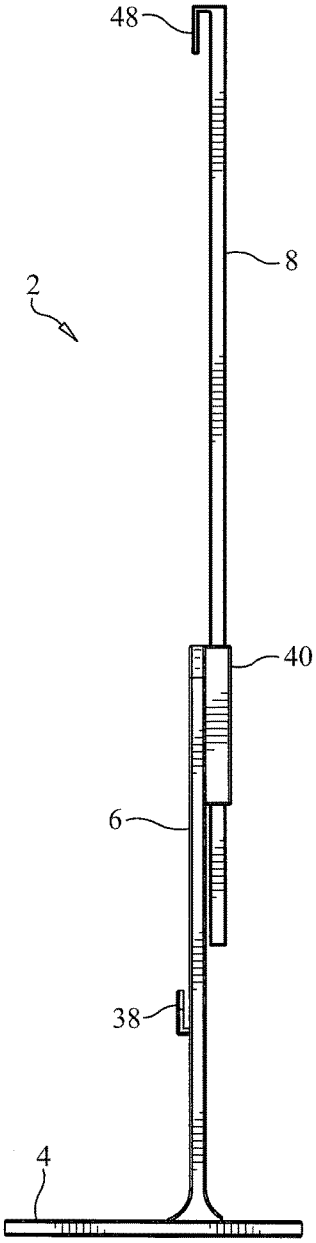
FIG. 3 is a left elevational view of the antenna stand of the present invention shown in FIGS. 1 and 2.
Figure 4:
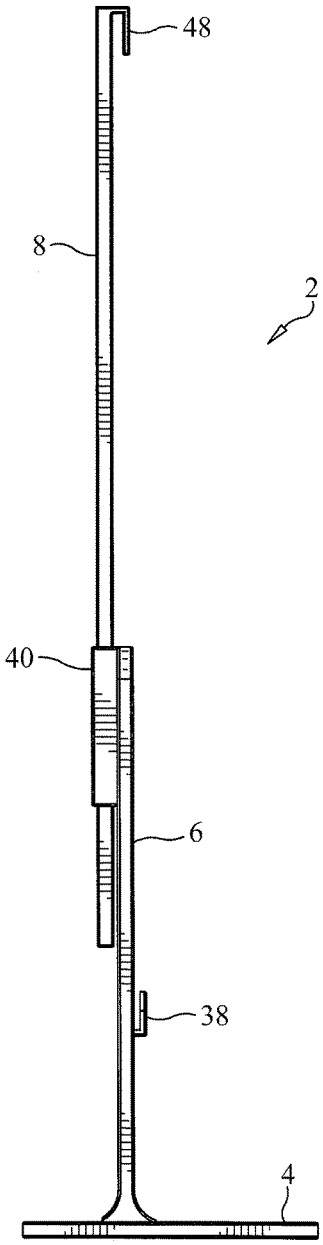
FIG. 4 is a right elevational view of the antenna stand of the present invention shown in FIGS. 1-3.
Figure 5:
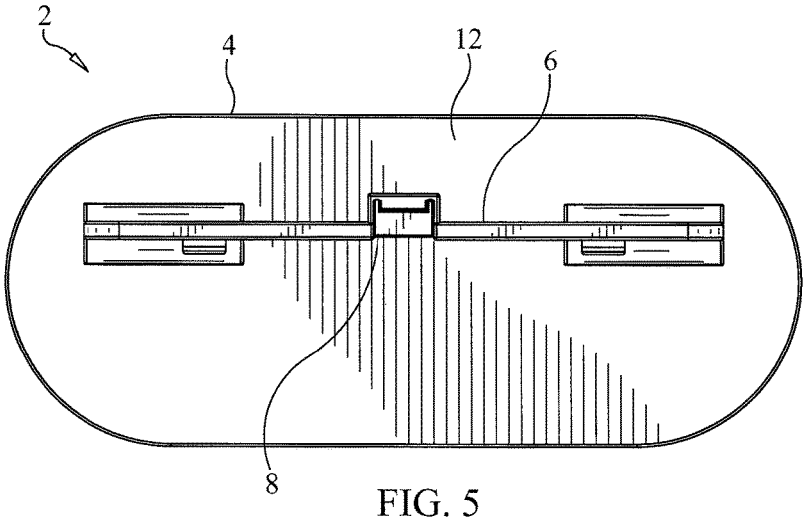
FIG. 5 is a top plan view of the antenna stand of the present invention shown in FIGS. 1-4.
Figure 6:
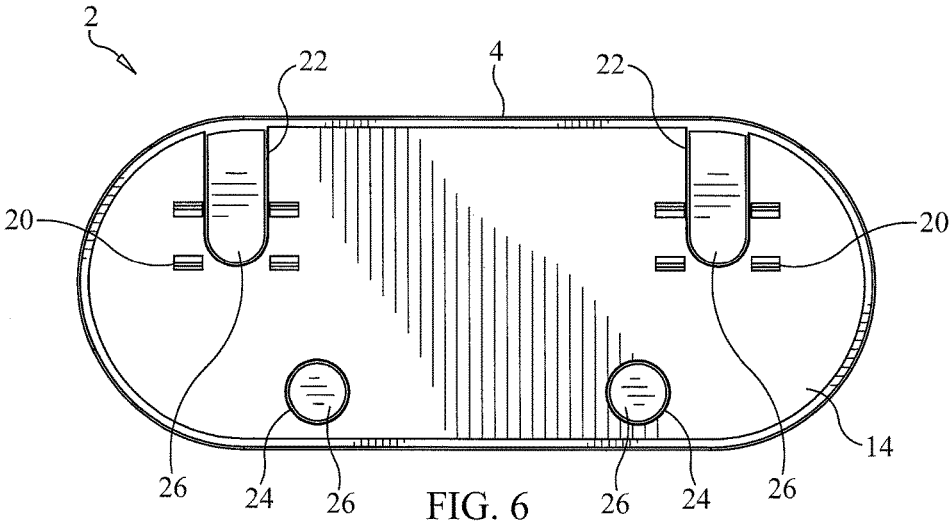
FIG. 6 is a bottom plan view of the antenna stand of the present invention shown in FIGS. 1-5.
Figure 7:
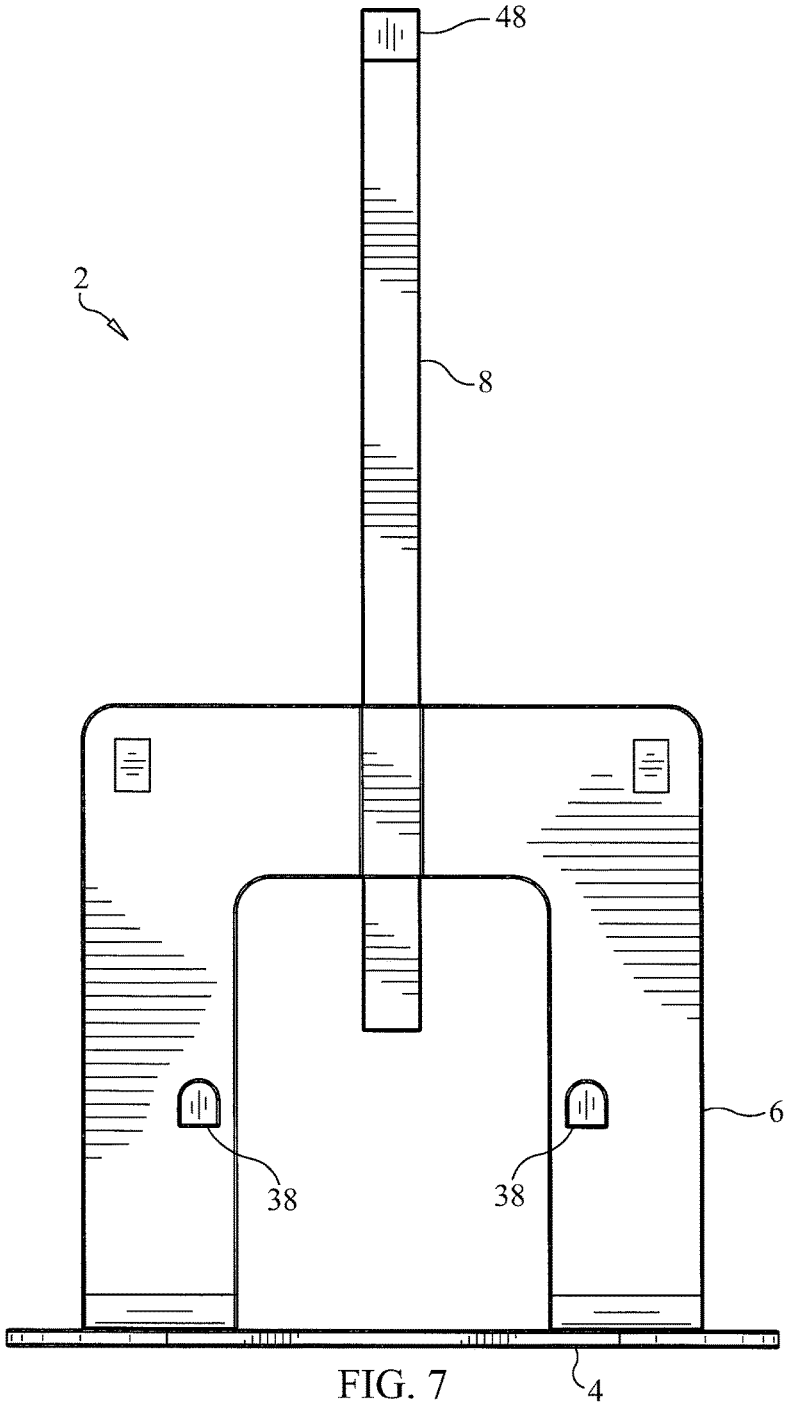
FIG. 7 is a front elevational view of the antenna stand of the present invention shown in FIGS. 1-6.
Figure 8:
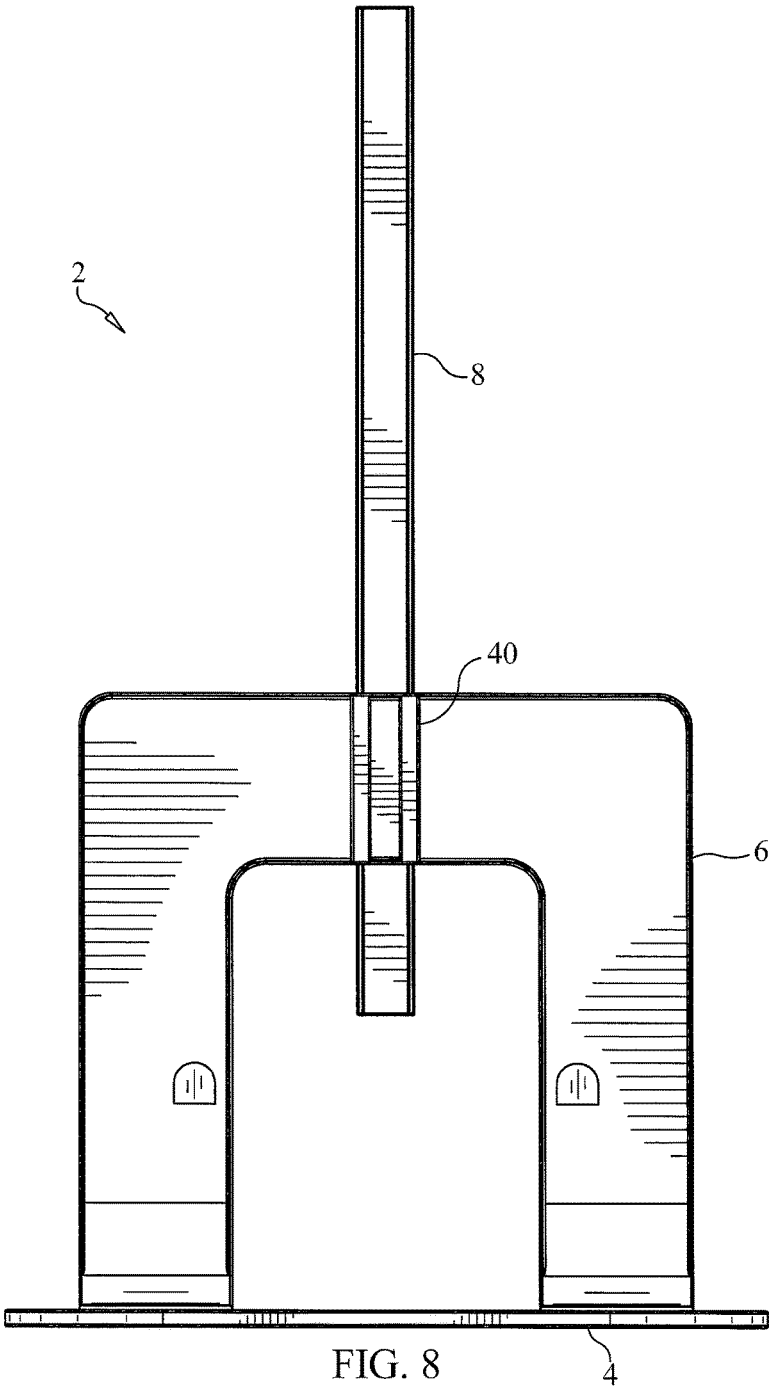
FIG. 8 is a rear elevational view of the antenna stand of the present invention shown in FIGS. 1-7.
Figure 9:
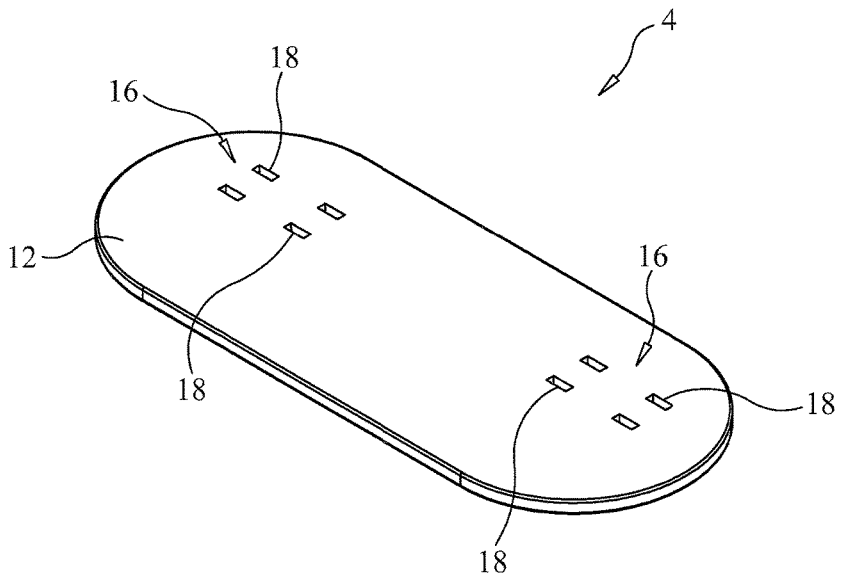
FIG. 9 is a front top perspective view of the base component of the antenna stand of the present invention shown in FIGS. 1-8.
Figure 10:
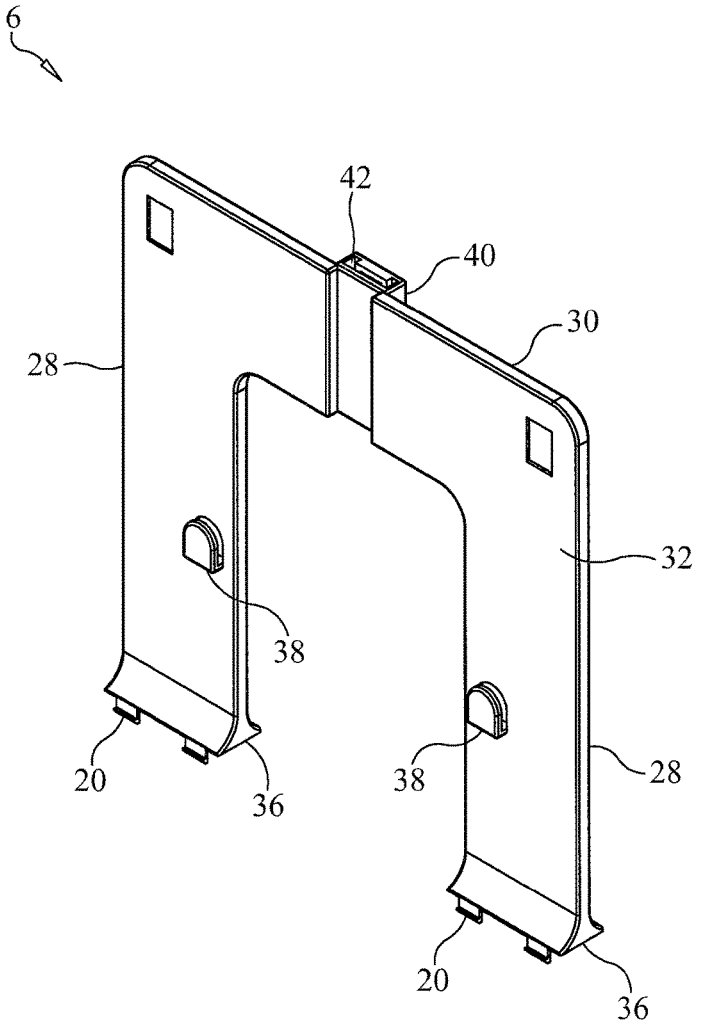
FIG. 10 is a front perspective view of the frame component of the antenna stand of the present invention shown in FIGS. 1-8.
Figure 11:
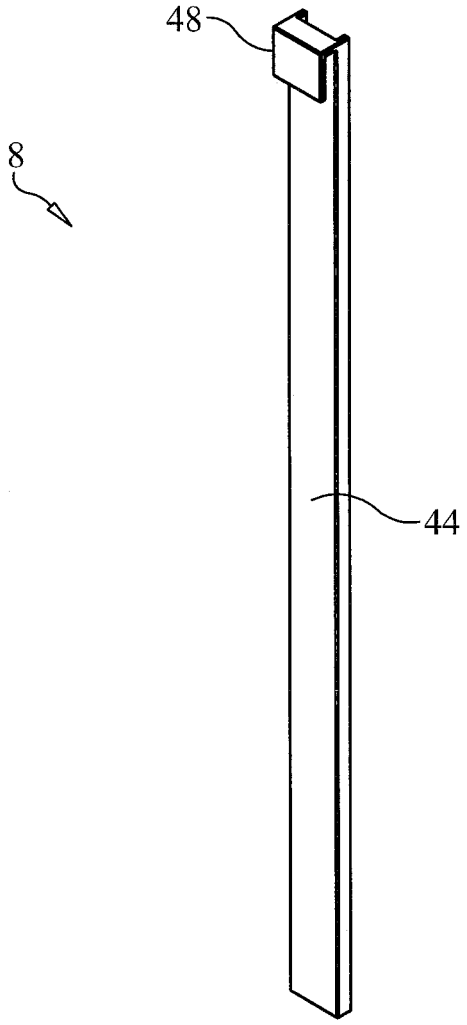
FIG. 11 is a front perspective view of the extendable arm component of the antenna stand of the present invention shown in FIGS. 1-8.

Reference should be initially had to FIGS. 1-11 of the drawings, where it will be seen that the antenna stand 2 constructed in accordance with a first form of the present invention basically includes three main components: a base 4, a support frame 6 mounted on the base 4, and an extendable arm 8 adjustably mounted on the support frame 6.

More specifically, the base 4 is a plate-like member which is preferably rectangular in shape with rounded corners to appear almost oval, although the base 4 can take on any shape, including round or oblong, as long as it provides adequate stability to the antenna stand 2 and an antenna 10 mounted thereon. The base 4 has a top side 12 and an opposite bottom side 14. Preferably, there are two groups 16 of openings formed through the thickness of the base 4, each group 16 consisting of four spaced apart slots 18. As will be described in greater detail, these slots 18 receive prongs 20 extending downwardly from the support frame 6 so that the support frame 6 may be mounted on and secured to the base 4.

On the bottom side 14 of the base 4 there are preferably four partition walls 22, 24 extending perpendicularly outwardly therefrom. Two of the walls 22 are preferably U-shaped and the other two walls 24 are preferably round in shape. The partition walls 22, 24 define an interior area 26 for receiving rubber feet (not shown) therewithin, the rubber feet being provided to minimize or prevent the base 4 and antenna stand 2 from slipping on or marring a surface of furniture or a window sill on which the antenna stand 2 is placed. The rubber feet may be secured to the surface of the bottom side 14 of the base 4 by using an adhesive or the like.

The support frame 6 stands upright on and perpendicular to the base 4. The support frame 6 is also generally a planar member preferably having a U-shape, with two opposite lateral, vertical legs 28 which are separated from and situated parallel to each other, and a transverse or horizontal cross member 30 joined to the upper sections of the lateral, vertical legs 28. The support frame 6 includes a front side 32 and an opposite rear side 34. The legs 28 are preferably spaced apart from each other to provide a space therebetween to accommodate a feed point housing found on some antennas, such as housing 40 disclosed in the aforementioned U.S. Patent Application Publication No. 2015/0054705 (i.e., U.S. Pat. No. 9,281,571), which housing 40 covers the feed point and the connection of the antenna cable to the antenna.

Each leg 28 of the support frame 6 includes an enlarged footing 36 formed by flaring outwardly in diverging directions the front and rear sides 32, 34 of the legs 28 at the bottom portion thereof. The bottom portion of each vertical leg 28 is formed with this enlarged footing 36 to provide a stable platform for resting on the base 4 of the antenna stand 2 and also to provide suitable surface area for forming thereon four spaced apart resilient prongs 20 on each leg 28. Each prong 20 includes a hooked edge, and the prongs 20 of each leg 28 are dimensioned and spaced apart from each other such that they are in alignment with and may be received by corresponding slots 18 formed in the base 4. The leg prongs 20 of the support frame 6 are inserted into respective slots 18 formed in the base 4 until their hooked edges pass below and engage the surface of the bottom side 14 of the base 4 to lock the support frame 6 in place on the base 4 in an upright, vertical position and perpendicular to the plane in which the base 4 resides.

Each vertical leg 28 of the support frame 6 includes at least one L-shaped lower clip 38 which projects outwardly from the surface of the front side 32 of the support frame 6 on each leg 28, although the lower clips 38 could be formed on the transverse cross member 30 in an alternative embodiment. The distance the L-shaped lower clips 38 project outwardly from the surface of the front side 32 of the support frame 6 is selected based on the overall thicknesses of commercially available planar television antennas such that an edge of the planar antenna 10 may be received by and rest on the L-shaped lower clips 38 of the support frame 6.

The transverse or horizontal cross member 30 of the support frame 6 includes a projection 40 formed on the rear side 34 of the support frame 6, the projection 40 defining a U-shaped channel 42 in transverse cross-section extending therethrough vertically when the support frame 6 is mounted on the base 4 in an upright position. The U-shaped channel 42 is provided to receive the extendable arm 8 of the antenna stand 2.

More specifically, the extendable arm 8 is formed as an elongated member having a U-shape in transverse cross-section which is complementary to that of the channel 42 so that it may be received in the U-shaped channel 42 of the support frame 6. The extendable arm 8 is closely received by the U-shaped channel 42 such that there is a friction fit between the interior walls of the channel projection 40 and the arm 8, but with sufficient force the extendable arm 8 may be raised and lowered vertically with respect to the support frame 6 when received in the U-shaped channel 42 thereof. The extendable arm 8 has a front side 44 and an opposite rear side 46.

The upper free end of the extendable arm 8 includes an L-shaped upper clip 48 which projects outwardly from the surface of the front side 44 thereof and in the same direction that the lower clips 38 project from the surface of the front side 32 of the support frame 6. Thus, because the extendable arm 8 is slidable under force within the U-shaped channel 42 of the support frame 6, the relative distance that the upper clip 48 of the arm 8 is spaced from the lower clips 38 of the support frame 6 is adjustable to accommodate the width or height of most commercially available planar television antennas. Also, the distance the L-shaped upper clip 48 projects from the surface of the front side 44 of the extendable arm 8 is selected, like the lower clips 38, based on the thicknesses of commercially available planar television antennas so that the upper or opposite edge of the planar television antenna may be received by and rest in the upper clip 48 of the extendable arm 8.

Figure 12:
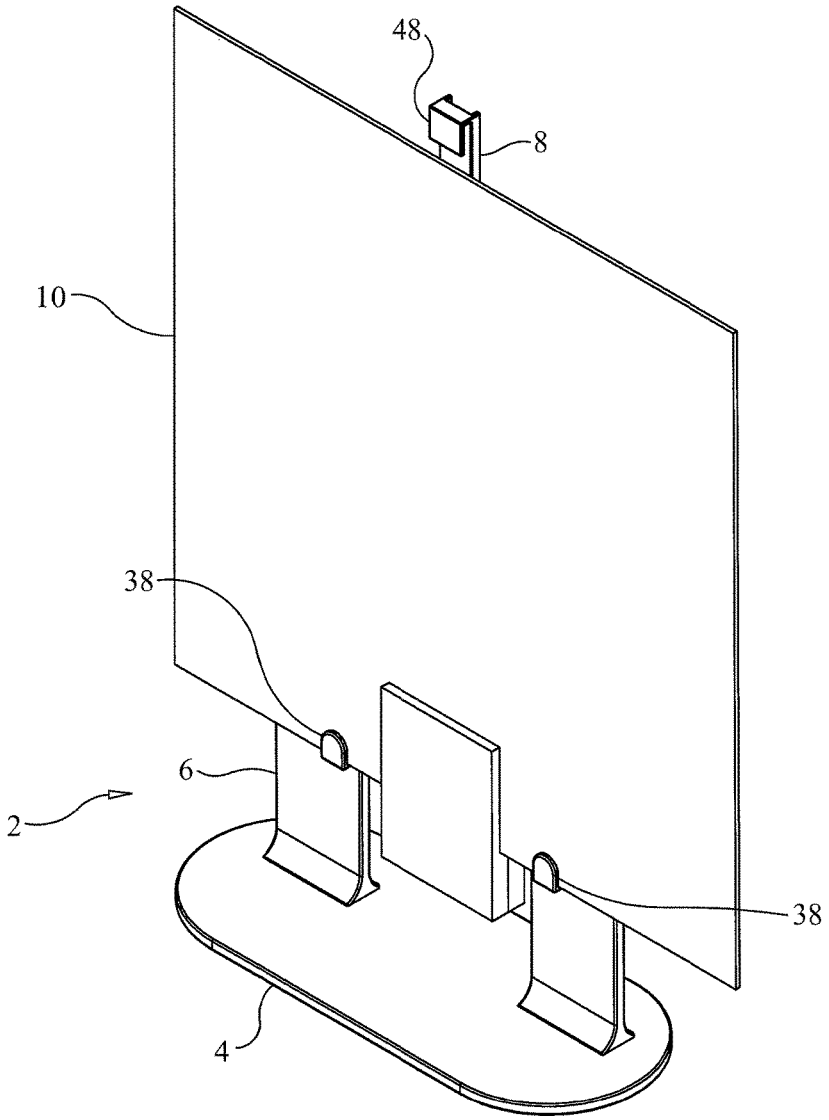
FIG. 12 is a front perspective view of the antenna stand of the present invention shown in FIGS. 1-8 and illustrating the antenna stand holding a planar television antenna in an upright position.
Figure 13:
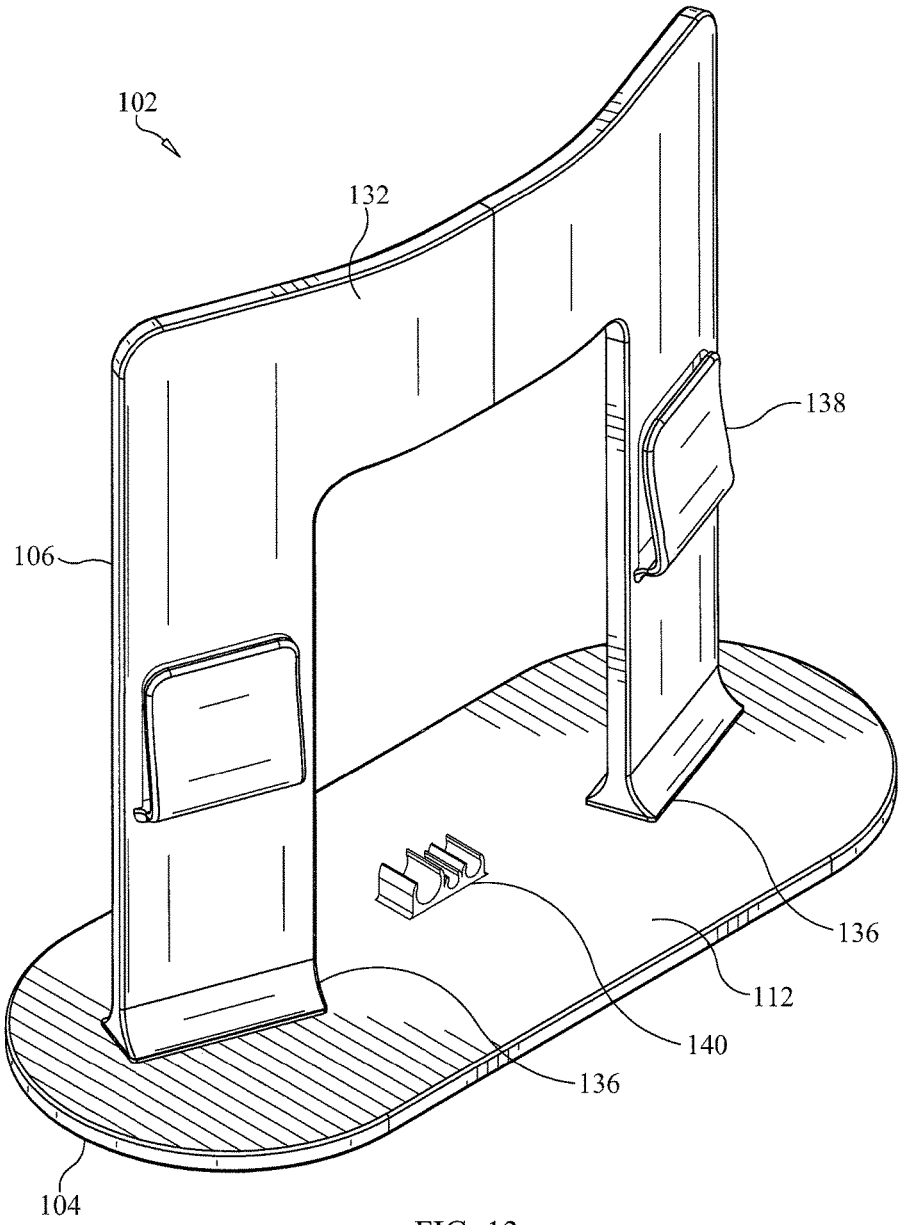
FIG. 13 is a front top perspective view of an antenna stand for holding a planar television antenna constructed in accordance with a second form of the present invention.
Figure 14:
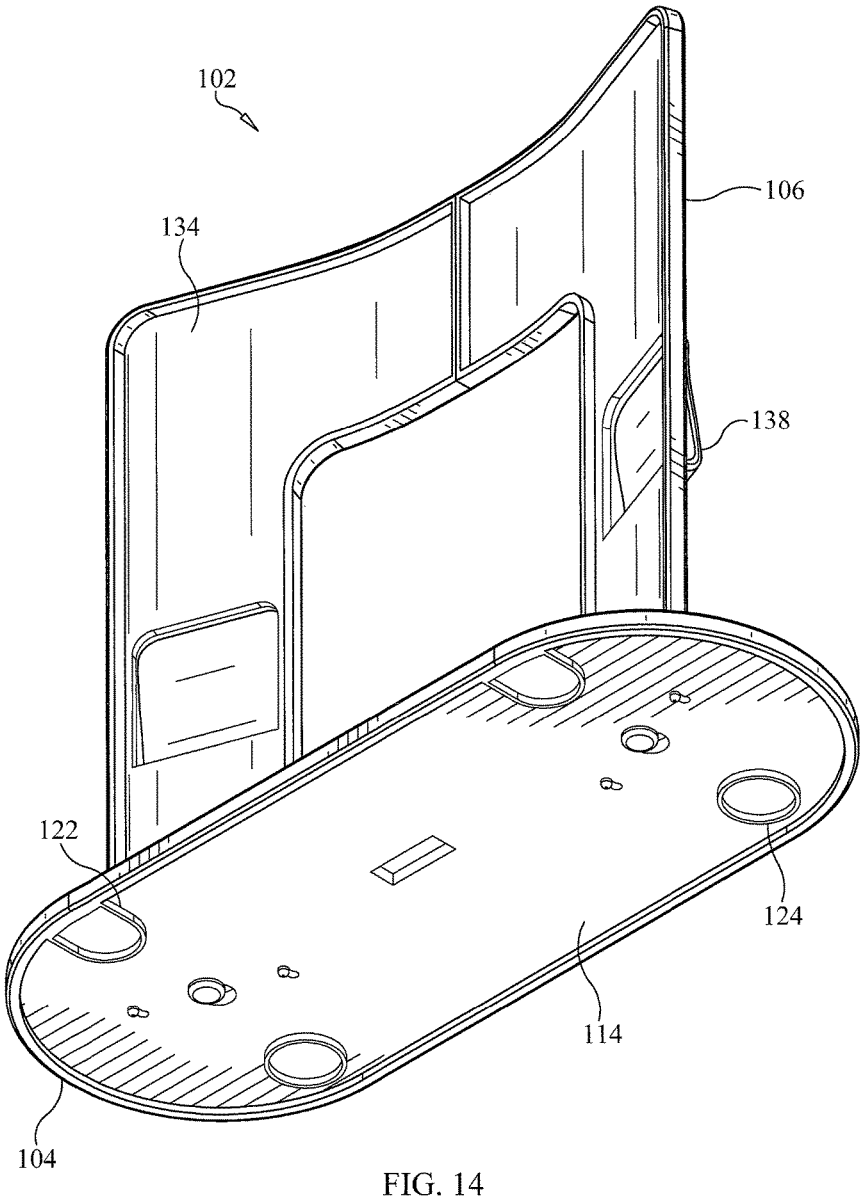
FIG. 14 is a rear bottom perspective view of the antenna stand of the present invention shown in FIG. 13.
Figure 15:
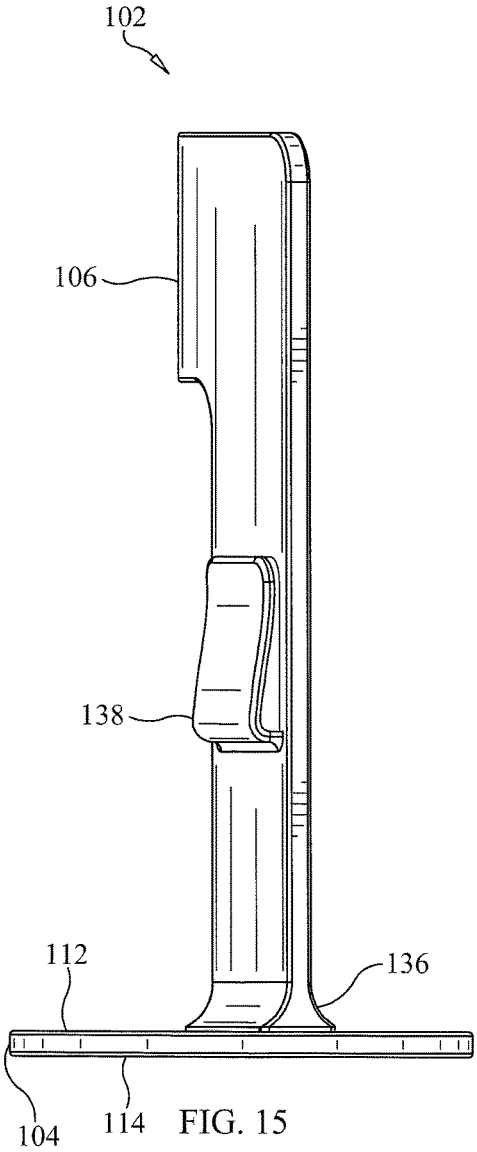
FIG. 15 is a right elevational view of the antenna stand of the present invention shown in FIGS. 13 and 14.
Figure 16:
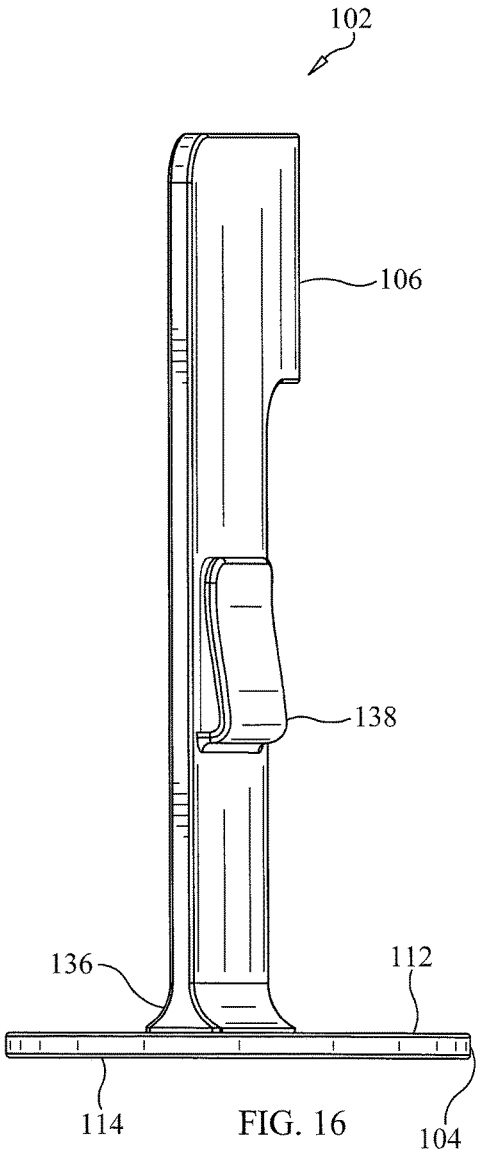
FIG. 16 is a left elevational view of the antenna stand of the present invention shown in FIGS. 13-15.
Figure 17:
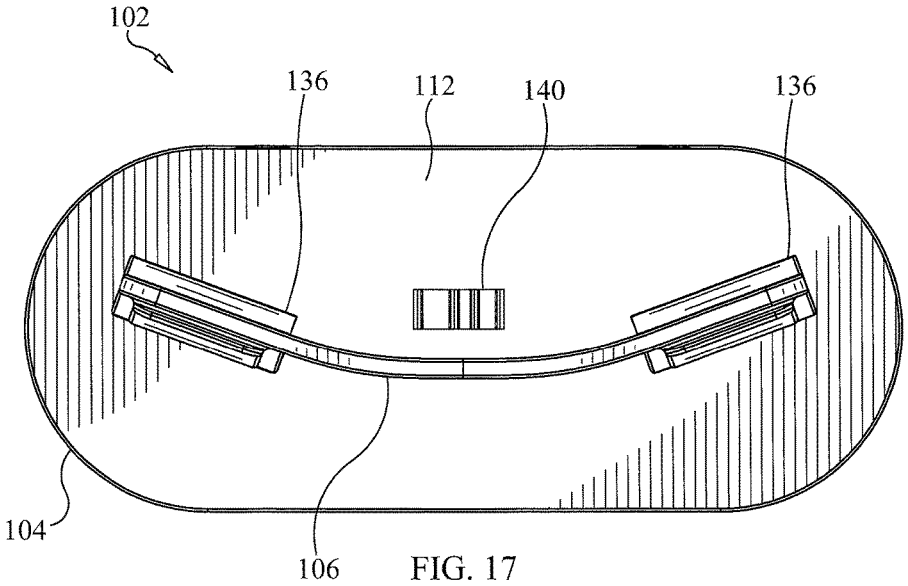
FIG. 17 is a top plan view of the antenna stand of the present invention shown in FIGS. 13-16.
Figure 18:
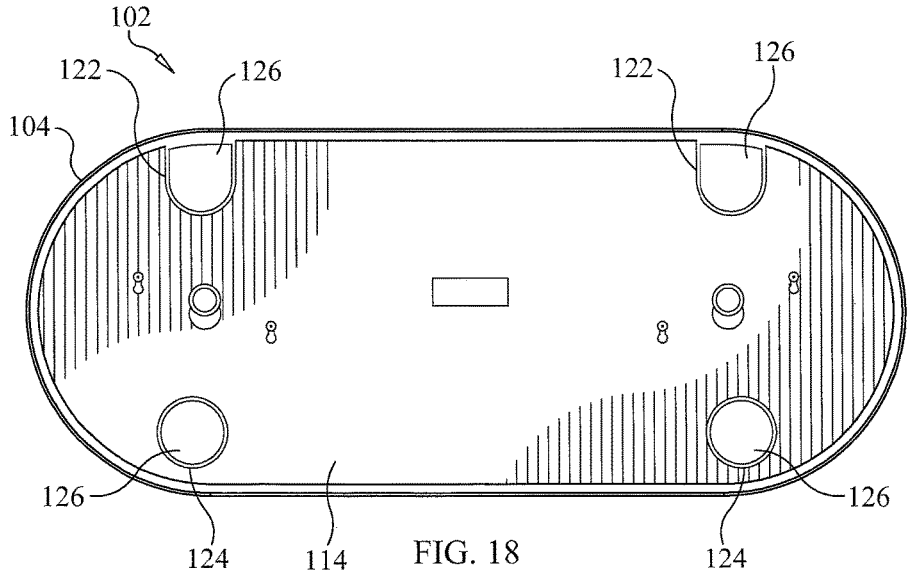
FIG. 18 is a bottom plan view of the antenna stand of the present invention shown in FIGS. 13-17.
Figure 19:
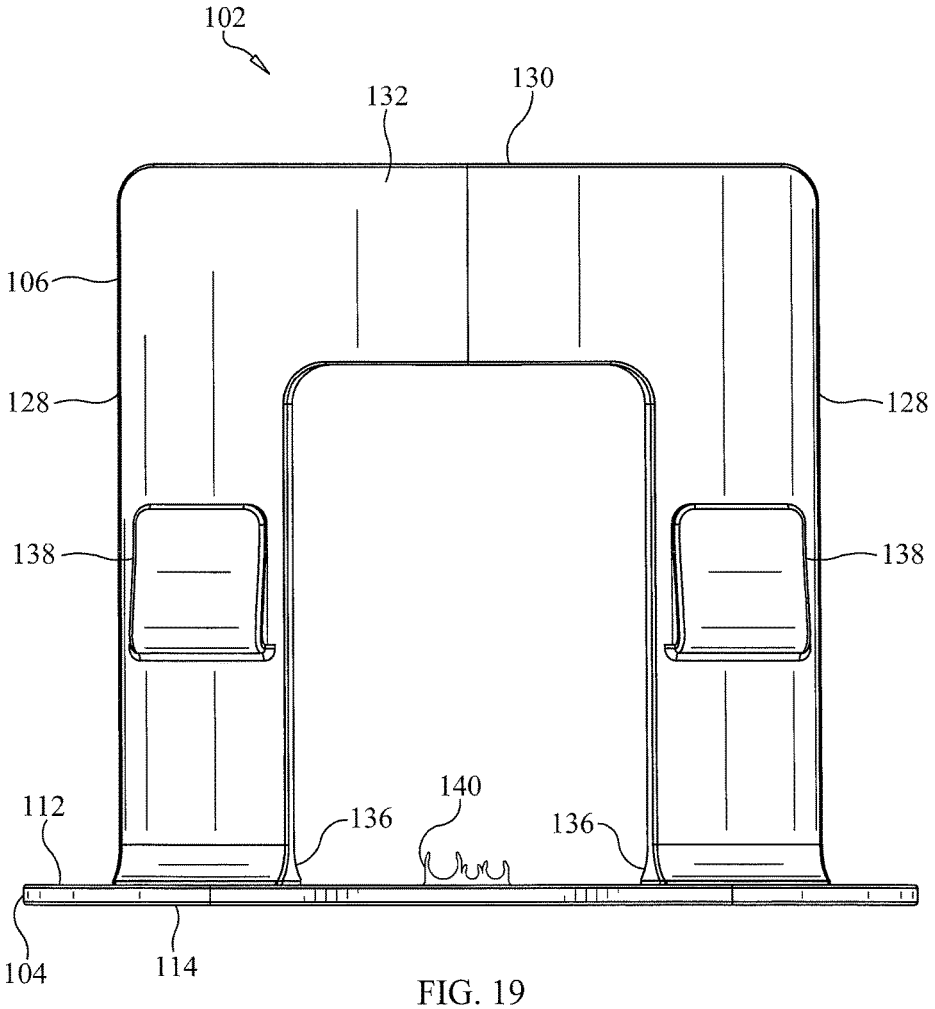
FIG. 19 is a front elevational view of the antenna stand of the present invention shown in FIGS. 13-18.
Figure 20:
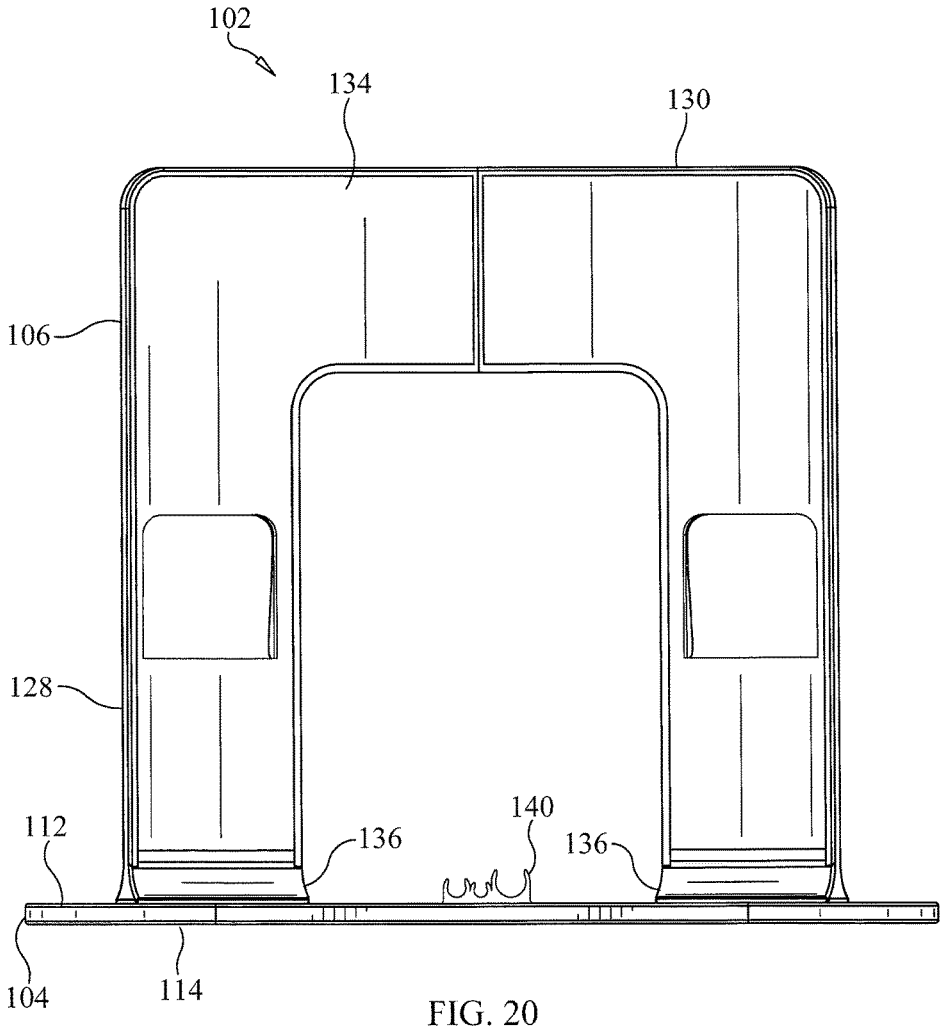
FIG. 20 is a rear elevational view of the antenna stand of the present invention shown in FIGS. 13-19.
Figure 21:
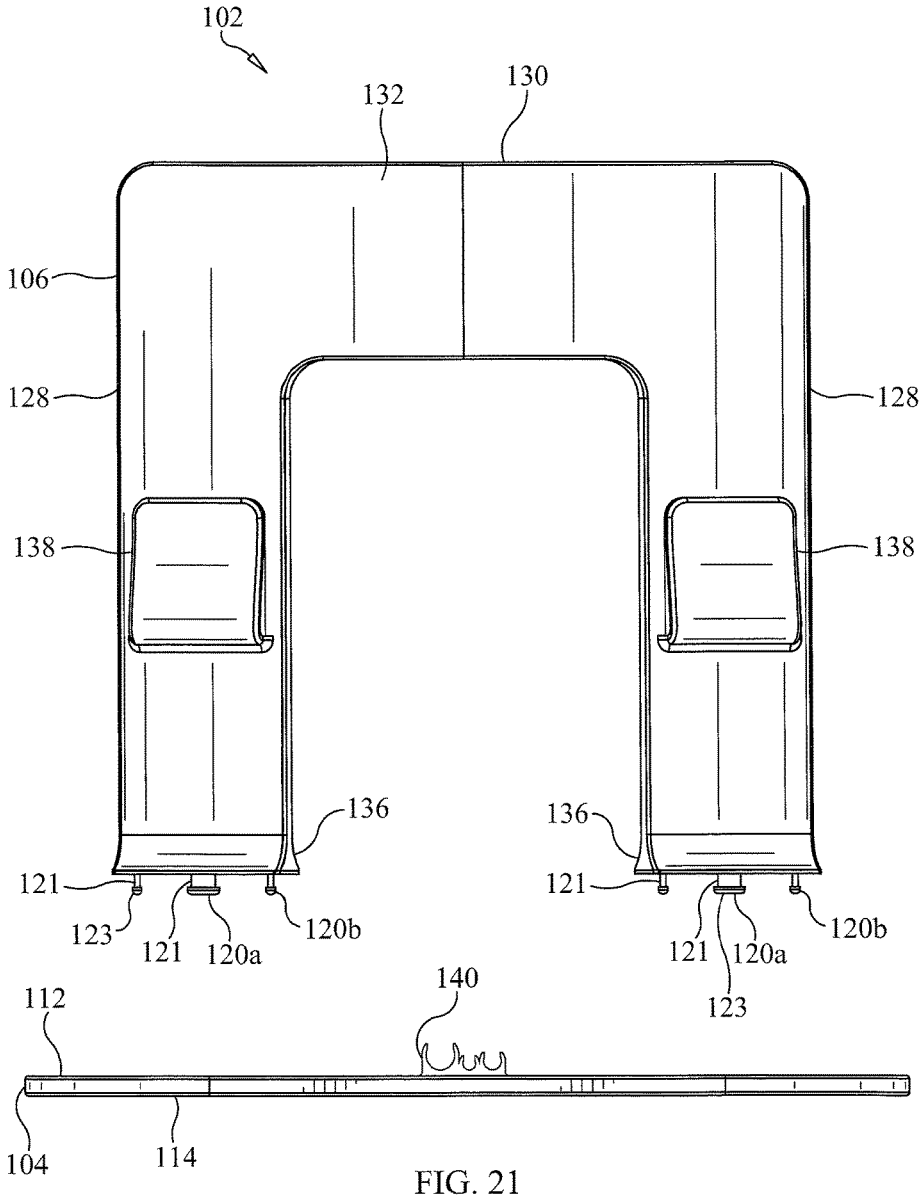
FIG. 21 is a partially exploded, front elevational view of the antenna stand of the present invention shown in FIGS. 13-20.
Figure 22:
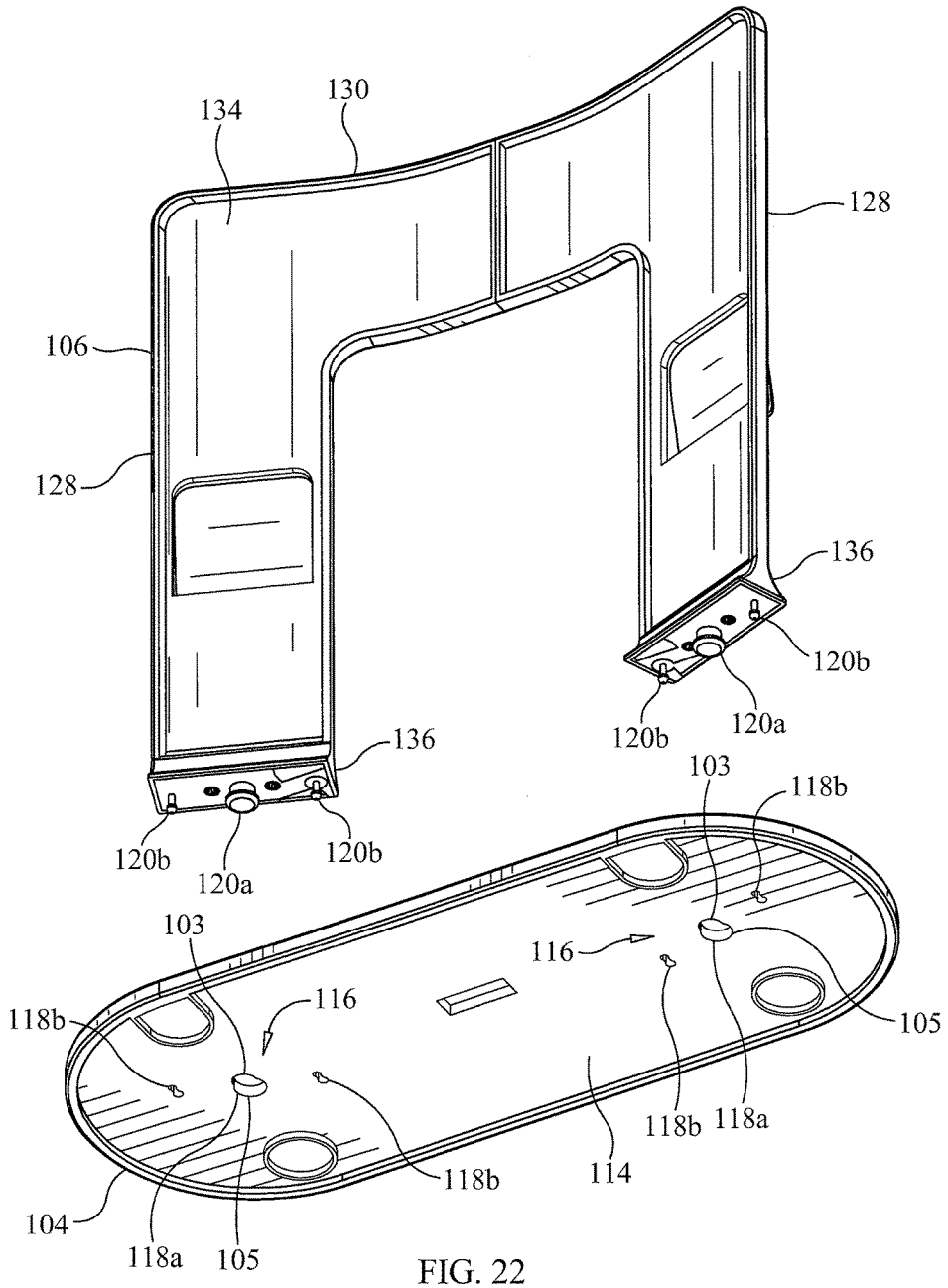
FIG. 22 is a partially exploded, rear bottom perspective view of the antenna stand of the present invention shown in FIGS. 13-21.

FIG. 12 illustrates how the antenna stand 2 of the present invention may support a planar television antenna 10 thereon in an upright position. As can be seen in FIG. 12, the lower edge of the planar television antenna 10 is received by and rests on the lower clips 38 formed on the legs 28 of the support frame 6. Then, the extendable arm 8 is adjusted such that the upper clip 48 thereon securely engages the opposite upper edge of the planar television antenna 10. Thus, the planar television antenna 10 is held in place between the lower and upper clips 38, 48 and supported on the antenna stand 2 in an upright, vertical position.

The antenna stand 2 of the present invention will support planar antennas 10 that include either a hard case enclosure or a flexible housing in an upright, vertical position and, for flexible antennas, without the antenna bending or bowing, as the vertical legs 28 and horizontal cross member 30 of the support frame 6 and the extendable arm 8 together provide sufficient support over the width or length of the planar antenna 10. Thus, the antenna stand 2 of the present invention may be placed on furniture or on a window sill, for example, and will hold the planar television antenna 10 in an upright position for best reception of high definition broadcast television signals.

Referring now to FIGS. 13-23 of the drawings, it can be seen that the antenna stand 102 formed in accordance with a second embodiment of the present invention basically includes two main components: a base 104 and a support frame 106 mounted on the base 104.

More specifically, the base 104 is a plate-like member which is preferably rectangular in shape with rounded corners to appear almost oval, although the base 104 can take on any shape, including round or oblong, as long as it provides adequate stability to the antenna stand 102 and an antenna 10 mounted thereon. The base 104 has a top side 112 and an opposite bottom side 114. Preferably, there are two groups 116 of openings formed through the thickness of the base 104, each group 116 consisting of three spaced apart keyhole-shaped slots 118, the center slot 118*a* being large than the two outer slots 118*b*. As will be described in greater detail, these three keyhole-shaped slots 118 receive locking pins 120 extending downwardly from the support frame 106 so that the support frame 106 may be mounted on and secured to the base 104. Each of the keyhole-shaped slots 118 preferably includes an enlarged diameter portion 105 and a reduced diameter portion 103 in communication with the enlarged diameter portion 105 and being relatively smaller than the enlarged portion 105. Preferably, as shown in FIGS. 14, 18, 21 and 22 of the drawings, each keyhole-shaped slot 118 of each of the groups 116 receives a corresponding locking pin 120 (i.e., a center locking pin 120*a* which is larger than two outer locking pins 120*b* of each of two groups of locking pins 120) aligned with it and extending downwardly from the support frame 106. Each locking pin 120 includes a shank 121 and an enlarged head 123 situated on the distal free end of the pin shank 121. When mounting the support frame 106 to the base 104, the enlarged head 123 of the locking pin 120 is pushed into the enlarged diameter portion 105 of a respective keyhole-shaped slot 118, and the support frame 106 is repositioned or shifted slightly on the base 104 such that the shank 121 of each locking pin 120 is moved into the reduced diameter portion 103 of a respective keyhole-shaped slot 118 on the base so as to hold captive the locking pin 120 within its corresponding slot 118 and to thus secure the support frame 106 of the antenna stand 102 to the base 104.

There is also a cable clip 140 mounted on the top side 112 of the base 104. The cable clip 140 preferably includes two pairs of different sized and spaced apart resilient prongs to hold between each respective pair a coaxial cable of different diameter.

On the bottom side 114 of the base 104 there are preferably four partition walls 122, 124 extending perpendicularly outwardly therefrom. Two of the walls 122 are preferably U-shaped and the other two walls 124 are preferably round in shape. The partition walls 122, 124 define an interior area 126 for receiving rubber feet (not shown) therewithin, the rubber feet being provided to minimize or prevent the base 104 and antenna stand 102 from slipping on or marring a surface of furniture or a window sill on which the antenna stand 102 is placed. The rubber feet may be secured to the surface of the bottom side 114 of the base 104 by using an adhesive or the like.

The support frame 106 stands upright on and perpendicular to the base 104. The support frame 106 is also generally a U-shaped member, with two opposite lateral, vertical legs 128 which are separated from and situated parallel to each other, and a transverse or horizontal cross member 130 joined to the upper sections of the lateral, vertical legs 128. The support frame 106 includes a front side 132 and an opposite rear side 134. The support frame 106 is also laterally arcuate in shape, that is, exhibiting a relatively small transverse curvature to appear either convex or concave when viewed from the front thereof. As will be explained in greater detail, the small curvature of the frame 106 of the antenna stand 102 will help hold a planar antenna, especially one which has a flexible housing, in an upright position when the antenna is mounted on the stand 102.

Each leg 128 of the support frame 106 includes an enlarged footing 136 formed by flaring outwardly in diverging directions the front and rear sides 132, 134 of the legs 128 at the bottom portion thereof. The bottom portion of each vertical leg 128 is formed with this enlarged footing 136 to provide a stable platform for resting on the base 104 of the antenna stand 102 and also to provide suitable surface area for forming thereon the three spaced apart locking pins 120, mentioned previously, on each leg 128.

As also described previously, each locking pin 120 includes a shank 121 extending from the bottom portion of the vertical leg 128 and a head portion 123. The locking pins 120 of each leg 128 are dimensioned and spaced apart from each other such that they are in alignment with and may be received by corresponding keyhole-shaped slots 118 formed in the base 104. The locking pins 120 of the support frame 106 are inserted into respective keyhole-shaped slots 118 formed in the base 104 through the enlarged diameter portions 105 thereof until the head portions 123 of the locking pins 120 pass below the surface of the bottom side 114 of the base 104. The legs 128 are then moved horizontally on the base 104 so that the shanks 121 of the locking pins 120 slide into the reduced diameter portions 103 of the keyhole-shaped slots 118. Accordingly, in this position, the head portions 123 of the locking pins 120, which have a diameter relatively larger than that of the reduced diameter portions 103 of the slots 118, are vertically secured below the surface of the bottom side 114 of the base 104 to lock the support frame 106 in place on the base 104 in an upright, vertical position and perpendicular to the plane in which the base 104 resides.

Each vertical leg 128 of the support frame 106 includes at least one L-shaped clip 138 which projects outwardly from the surface of the front side 132 of the support frame 106 on each leg 128, although the clips 138 could be formed on the transverse cross member 130 in an alternative embodiment. The distance the L-shaped clips 138 project outwardly from the surface of the front side 132 of the support frame 106 is selected based on the overall thicknesses of commercially available planar television antennas such that an edge of the planar antenna may be received by and rest on the L-shaped clips 138 of the support frame 106.

Figure 23:
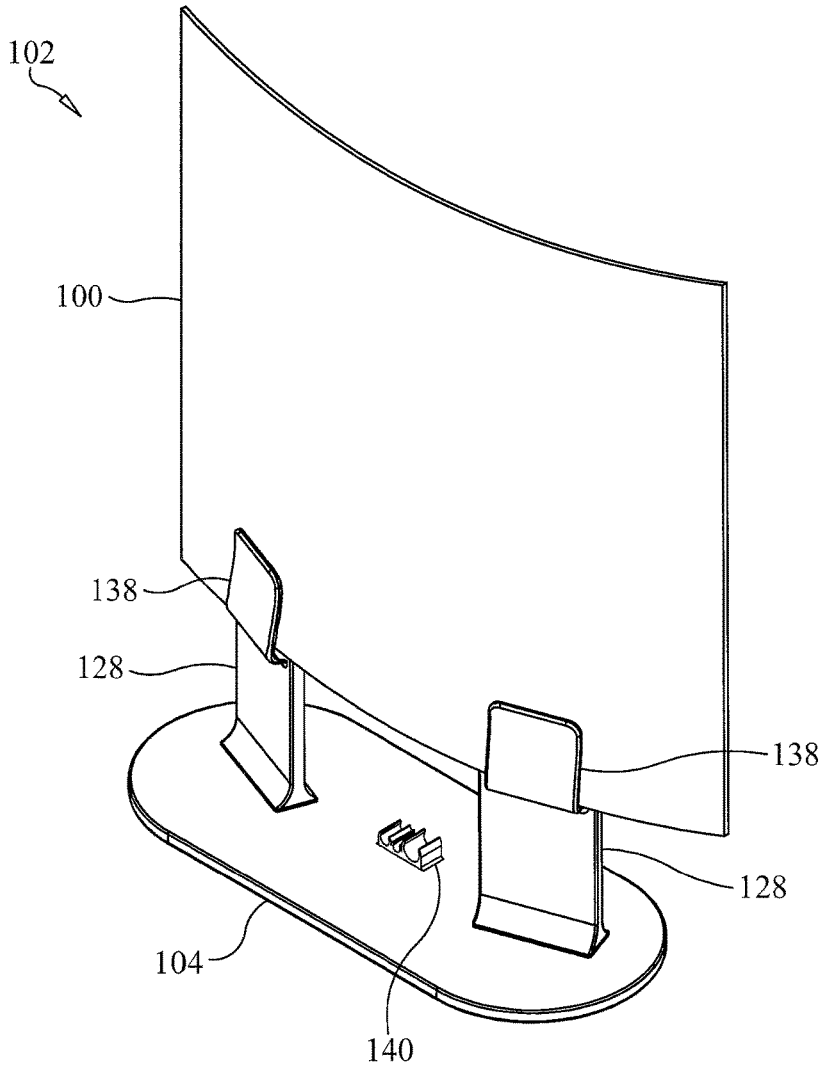
FIG. 23 is a front perspective view of the antenna stand of the present invention shown in FIGS. 13-22 and illustrating the antenna stand holding a flexible planar television antenna in an upright position.

By providing the support frame 106 of the antenna stand 102 with a small transverse curvature, any planar antenna 10 having a flexible housing or covering mounted on the stand will take on the same transverse curvature. In other words, and as illustrated in FIG. 23 of the drawings, the planar antenna 10 will also bend slightly in a transverse or horizontal direction symmetrically about a vertical axis, and this bend will maintain the antenna 10 in an upright position on the stand 102 without slumping or folding over on itself. The planar antenna 10 will remain in this upright position even though it only rests at its lower edge on the clips 138 of the stand 102 and without the need for the antenna stand 102 to support the upper edge of the antenna.

To utilize the antenna stand 102 formed in accordance with the second embodiment of the present invention, the lower edge of the planar television antenna 10 is received by and rests on the clips 138 formed on the legs 128 of the support frame 106. Thus, the planar television antenna 10 is held in place by the clips 138 and supported on the antenna stand 102 in an upright, vertical position. Furthermore, the clips 138 may be resilient and inwardly biased towards the support frame 106. The resiliency of the clips 138 provides additional support to the antenna 10. When the antenna stand 102 is used to support a flexible planar antenna 10, the curvature of the frame 106 shapes the antenna 10 and limits the ability of the antenna to collapse by providing support thereto.

The antenna stand 102 formed in accordance with the second embodiment of the present invention will support planar antennas 10 that include either a hard case enclosure or a flexible housing in an upright, vertical position and, for flexible antennas, without the antenna bending or bowing, as the vertical legs 128 and horizontal cross member 130 of the support frame 106 provide sufficient support over the width or length of the planar antenna 10. For planar antennas 10 with a non-flexible housing, the clips 138 just need to be made such that they project out from the surface of the front side 132 of the support frame 106 a sufficient distance to compensate for the lateral curvature of the frame 106. Thus, the antenna stand 102 of the present invention may be placed on furniture or on a window sill, for example, and will hold the planar television antenna 10 in an upright position for best reception of high definition broadcast television signals.

Although illustrative embodiments of the present invention have been described herein with reference to the accompanying drawing, it is to be understood that the invention is not limited to those precise embodiments, and that various other changes and modifications may be effected therein by one skilled in the art without departing from the scope or spirit of the invention.

What is claimed is:

1. An antenna stand, which comprises:

a base having a top surface and a bottom surface disposed opposite the top surface;

a support frame having a front side and a rear side disposed opposite the front side;

at least one lower antenna support, the at least one lower antenna support being situated on at least one of the front side and rear side of the support frame; and an antenna holding arm having a first axial end and a second axial end disposed opposite the first axial end;

wherein the support frame includes an upper portion and a lower portion disposed opposite the upper portion, the lower portion of the support frame being affixed to or engageable with the base;

wherein a planar antenna having a top edge and a bottom edge disposed opposite the top edge is supported by the antenna stand, wherein the bottom edge of the planar antenna rests on the at least one lower antenna support;

wherein the antenna holding arm is situated on the support frame and is selectively extendable therefrom to vary the distance between the second axial end of the antenna holding arm and the lower antenna support to accommodate and support planar antennas of various sizes;

wherein the support frame further includes means defining a channel, the channel defining means being situated on at least one of the front side and the rear side thereof;

wherein a portion of the antenna holding arm near the first axial end thereof is receivable in the channel and is selectively extendable therefrom; and wherein the extendable antenna holding arm includes at least one upper antenna support situated near the second axial end of the holding arm and projecting therefrom in a direction outwardly from at least one of the front side and the rear side of the support frame.

2. An antenna stand as defined by claim 1, wherein:

the channel defining means includes a projection situated on at least one of the front side and the rear side of the support frame.

3. An antenna stand as defined by claim 2, wherein:

the support frame has a laterally arcuate shape.

4. An antenna stand as defined by claim 1, wherein:

the support frame has a planar shape.

5. An antenna stand as defined by claim 1, wherein the base further comprises a plurality of partition walls that extend outwardly and perpendicularly from the bottom surface thereof, the plurality of partition walls defining at least one interior space for receiving at least one support foot.

6. An antenna stand as defined by claim 1, wherein the lower antenna support further comprises a first portion that extends outwardly from the support frame and a second resilient portion that extends perpendicularly upwardly from the first portion and is biased inwardly towards the frame.

7. An antenna stand as defined by claim 1, wherein the base includes a cable clip, the cable clip being mounted on the top surface of the base; and wherein the cable clip comprises at least one pair of spaced apart resilient prongs to hold an electrical cable therebetween.

8. An antenna stand, which comprises:

a base having a top surface and a bottom surface disposed opposite the top surface;

a support frame having a front side and a rear side disposed opposite the front side; and at least one lower antenna support, the at least one lower antenna support being situated on at least one of the front side and rear side of the support frame;

wherein the support frame includes an upper portion and a lower portion disposed opposite the upper portion, the lower portion of the support frame being affixed to or engageable with the base;

wherein a planar antenna having a top edge and a bottom edge disposed opposite the top edge is supported by the antenna stand, wherein the bottom edge of the planar antenna rests on the at least one lower antenna support;

wherein the support frame further comprises at least two vertical legs situated opposite and parallel to each other, the at least two vertical legs being separated from each other to define a space therebetween, each of the at least two vertical legs having an upper portion and a lower portion disposed opposite the upper portion, a first axial end and a second axial end disposed opposite the first axial end, and a front side and a rear side disposed opposite to the front side; and a horizontal cross member having a front surface and a rear surface disposed opposite the front surface, the horizontal cross member interconnecting the upper portions of the at least two vertical legs;

wherein the horizontal cross member and the upper portions of the at least two vertical legs define the upper portion of the support frame, and the lower portions of the at least two vertical legs define the lower portion of the support frame;

wherein the front sides of the vertical legs and the front side of the horizontal cross member define the front side of the support frame, and the rear sides of the vertical legs and the rear side of the horizontal cross member define the rear side of the support frame; and wherein the at least one lower antenna support includes at least a first antenna support and a second antenna support situated on the at least two vertical legs.

9. An antenna stand as defined by claim 8, wherein each vertical leg of the at least two vertical legs includes a footing, the footings being situated in proximity to the second axial ends of the at least two vertical legs;

wherein each footing comprises at least a first portion and a second portion disposed opposite the first portion, the first portion and the second portion flaring outwardly in diverging lateral directions from the front side and rear side of each leg, respectively, in proximity to the second axial end thereof; and wherein the first portion and the second portion of the footing of each leg together define a bottom surface of the footing, the bottom surface of the footing resting on the top surface of the base.

10. An antenna stand as defined by claim 9, wherein the bottom surface of each footing includes at least one resilient prong that extends outwardly therefrom, the resilient prong being aligned with and received by a corresponding slot formed at least partially through the thickness of the base, wherein the prong and the slot are selectively engageable with each other to secure the support frame to the base.

11. An antenna stand as defined by claim 10, wherein the at least one resilient prong of each footing includes a plurality of resilient prongs extending outwardly from the bottom surface of the footing; and wherein the base has formed therein at least two groups of slots, the slots of each group of the at least two groups of slots being aligned with the respective resilient prongs of the plurality of resilient prongs of each footing so that the resilient prongs are receivable by a respective slot of the at least two groups of slots.

12. An antenna stand as defined by claim 10, wherein each prong includes:

a first axial end and a second axial end disposed opposite the first axial end, the first axial end being joined to the bottom surface of the footing; and a hooked portion, the hooked portion being situated at the second axial end of the prong;

wherein each prong is inserted into and is receivable by a respective slot formed in the base so that the hooked portion extends therethrough and engages the bottom surface of the base.

13. An antenna stand as defined by claim 9, wherein each footing includes at least one locking pin formed on the bottom surface thereof and extending outwardly from the bottom surface, the locking pin being aligned with and receivable by a keyhole-shaped slot formed at least partially through the thickness of the base, the keyhole-shaped slot including an enlarged diameter portion and a reduced diameter portion which is in communication with the enlarged diameter portion and which has a transverse dimension which is less than the diameter of the enlarged diameter portion, wherein the locking pin and the keyhole-shaped slot are selectively engageable with each other to join the support frame to the base.

14. An antenna stand as defined by claim 13, wherein each locking pin further comprises:

a first axial end and a second axial end disposed opposite the first axial end, the first axial end being joined to the bottom surface of the footing;

an enlarged head portion, the enlarged head portion being situated on the second axial end of the locking pin; and a shank situated between and interconnecting the enlarged head portion and the first axial end of the locking pin;

wherein the enlarged head portion of the locking pin is inserted through and received by the enlarged diameter portion of the keyhole slot formed in the base so that the enlarged head portion extends beyond the bottom surface of the base;

wherein, when the support frame is shifted on the base, the shank of the locking pin is moved into and received by the reduced diameter portion of a respective keyhole slot; and wherein the diameter of the reduced diameter portion of the keyhole slot is less than the diameter of the enlarged head portion of the locking pin so that, when the locking pin is shifted within a respective keyhole slot, the enlarged head portion is secured below the bottom surface of the base, thereby joining the support frame and the base together.

15. An antenna stand as defined by claim 14, wherein each footing includes a group of locking pins, at least one of the locking pins in the group of locking pins having a size that is different from that of at least one other locking pin in the group of locking pins; and wherein the base includes at least two groups of keyhole slots, each keyhole slot of the groups of keyhole slots being aligned with and being complementary in size to a respective locking pin of the groups of locking pins situated on the footings so as to closely receive the respective locking pin.

16. An antenna stand as defined by claim 15, wherein each group of locking pins includes two outer locking pins and one center locking pin, the center locking pin being positioned between the two outer locking pins, the center locking pin being larger than the two outer locking pins; and wherein the center locking pin and outer locking pins of each group of locking pins are aligned and engageable with respective complementary-dimensioned keyhole slots of the groups of keyhole slots formed in the base.

17. An antenna stand as defined by claim 8, wherein: the support frame has a planar shape.

18. An antenna stand as defined by claim 8, wherein: the support frame has a laterally arcuate shape.

19. An antenna stand as defined by claim 8, wherein the lower antenna support further comprises a first portion that extends outwardly from the support frame and a second resilient portion that extends perpendicularly upwardly from the first portion and is biased inwardly towards the frame.

20. An antenna stand as defined by claim 8, wherein the base includes a cable clip, the cable clip being mounted on the top surface of the base; and wherein the cable clip comprises at least one pair of spaced apart resilient prongs to hold an electrical cable therebetween.

* * * * *